US012734408B2

(12) United States Patent
Tegeder et al.

(10) Patent No.: US 12,734,408 B2
(45) Date of Patent: Sep. 15, 2026

(54) BALANCE BOARD SYSTEM

(71) Applicant: Lakesurf, LLC, Murrieta, CA (US)

(72) Inventors: Troy Tegeder, Winchester, CA (US); Stephen Hale, Winchester, CA (US)

(73) Assignee: Lakesurf, LLC, Murrieta, CA (US)

( * ) Notice: Subject to any disclaimer, the term of this patent is extended or adjusted under 35 U.S.C. 154(b) by 262 days.

(21) Appl. No.: 18/047,937

(22) Filed: Oct. 19, 2022

(65) Prior Publication Data

US 2024/0131399 A1 Apr. 25, 2024
US 2024/0226664 A9 Jul. 11, 2024

(51) Int. Cl.

*A63B 26/00* (2006.01)
*A63B 24/00* (2006.01)
*A63B 71/06* (2006.01)

(52) U.S. Cl.

CPC ..... *A63B 26/003* (2013.01); *A63B 24/0021* (2013.01); *A63B 71/0622* (2013.01); *A63B 2024/0025* (2013.01); *A63B 2071/0638* (2013.01); *A63B 2220/17* (2013.01); *A63B 2220/833* (2013.01); *A63B 2230/75* (2013.01)

(58) Field of Classification Search

CPC ..... A63B 2220/833; A63B 2220/17; A63B 26/00; A63B 26/003; A63B 24/0021; A63B 70/0622; A63B 2024/0025; A63B 2071/0638; A63B 2230/75; H04B 1/3888; A45F 5/00; A45F 5/02

See application file for complete search history.

(56) References Cited

U.S. PATENT DOCUMENTS 9,101,831 B2 * 8/2015 Sauerbrei ..... A63F 13/245
10,583,321 B2 3/2020 Panes
(Continued)

FOREIGN PATENT DOCUMENTS

GB 2620728 A * 1/2024 ..... A63B 22/16
KR 20220161694 A * 12/2022 ..... H04B 1/3888

OTHER PUBLICATIONS

Webpage for the Phone Mount of the Wakesurf Balance Board System from Lakesurf.com (Year: 2023).*
(Continued)

*Primary Examiner* — Megan Anderson
*Assistant Examiner* — Jonathan A Dicuia
(74) *Attorney, Agent, or Firm* — Kirton McConkie; Brian Tucker

(57) ABSTRACT

A balance board system may include a balance board, a phone that is mounted to the balance board, and a display device on which a virtual environment may be displayed. The virtual environment can include a representation of the balance board that is oriented based on the balance board's orientation as detected by the phone. The virtual environment can enable a user to learn and practice tricks or other activities on a balance board. A phone mount can be used to mount the phone to the balance board. By mounting the phone to the balance board, software on the phone can be used to detect and monitor the balance board's movement to thereby assist the user in improving balance or learning various tricks, movements or techniques. The software on the phone can also allow the user to generate inputs for various games that can be portrayed in the virtual environment.

19 Claims, 17 Drawing Sheets

(56) References Cited

U.S. PATENT DOCUMENTS

| | | | | |
|---|---|---|---|---|
| 2007/0155495 | A1* | 7/2007 | Goo | A63B 24/0003 463/36 |
| 2017/0007902 | A1* | 1/2017 | Cottam | G16H 40/63 |
| 2017/0095694 | A1* | 4/2017 | Polinsky | A63F 13/211 |
| 2018/0264321 | A1* | 9/2018 | Nir | A63F 13/245 |

OTHER PUBLICATIONS

NautiCurl.com page advertising the Wakesurf Balance Board system published Dec. 10, 2020 (Year: 2020).*

* cited by examiner

BALANCE BOARD SYSTEM

CROSS-REFERENCE TO RELATED APPLICATIONS

N/A

BACKGROUND

Balance boards are commonly used in athletics, recreation and other industries to help users improve their balance and agility. A balance board is formed of two primary components: a board on which a user stands; and a fulcrum on which the board is supported. As the user stands on the board, the board will be free to pivot around the fulcrum thus requiring the user to maintain his or her balance to prevent the board from contacting the ground.

Various types of balance boards exist. For example, some balance boards may have a fixed fulcrum, while others may have a fulcrum that may roll or otherwise move relative to the board. Also, some balance boards may have a fulcrum that allows the board to tilt only in two directions, while others may have a fulcrum that allows the board to tilt in every direction.

FIGS. 1A-1C are top, perspective and bottom views respectively of a balance board 100. Balance board 100 includes a board 110 having a top surface 111 and a bottom surface 112 and a fulcrum 120 that is fixed at the center of bottom surface 112. Fulcrum 120 has an elongated semi-spherical shape which enables board 110 to tilt in every direction. Board 110 has a shape that generally resembles a wakesurf board. Accordingly, an individual could use balance board 100 to improve his or her balance while wakesurfing.

FIG. 2 illustrates a different type of balance board 200. Balance board 200 includes a board 210 having a top surface 211 and a bottom surface 212 and a fulcrum 220 that is not fixed to board 210. Fulcrum 220 has a cylindrical shape which allows it to roll underneath board 210. Board 210 has a shape that generally resembles a skateboard. Accordingly, an individual could use balance board 200 to improve his or her balance while skating.

BRIEF SUMMARY

Embodiments of the present invention extend to a balance board system that may include a balance board, a phone that is mounted to the balance board, and a display device on which a virtual environment may be displayed. The virtual environment can include a representation of the balance board that is oriented based on the balance board's orientation as detected by the phone. The virtual environment can enable a user to learn and practice tricks or other activities on a balance board.

Software, such as a mobile application, can be used on the phone to detect and monitor the balance board's movement to thereby assist the user in improving his or her balance or learning various tricks, movements or techniques while using the balance board. The software can also be used to generate the virtual environment including to provide feedback when detecting the user's performance of a trick or other movement.

Embodiments of the present invention also extend to a phone mount that can be used to mount the phone to the balance board such as when the balance board is not configured to secure a phone. A balance board phone mount can include a body that is configured to envelope a phone and a base that is configured to secure the body to the bottom of the board of the balance board.

In some embodiments, the present invention may be implemented as a balance board system that includes one or more computer storage media storing computer executable instructions which when executed on a phone that is mounted to a balance board implement a method that includes: obtaining orientation data from one or more sensors of the phone while the phone is mounted to the balance board; and based on the orientation data, tracking an orientation of the balance board.

In some embodiments, the present invention may be implemented as balance board system that includes a balance board phone mount with a body and a base. The body having a top side, a bottom side, a first side, a second side opposite the first side, a first extension and a second extension opposite the first extension. The base is positioned on the top side of the body and is configured to secure the body to a bottom of a board of a balance board.

In some embodiments, the present invention may be implemented by software on a phone that is mounted to a balance board as a method for tracking motion of the balance board. The software may obtain orientation data from one or more sensors of the phone while the phone is mounted to the balance board. The balance board may use the orientation data to calculate an orientation of the balance board. The balance board may output a representation of the balance board, the representation being oriented in accordance with the calculated orientation of the balance board.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

Understanding that these drawings depict only typical embodiments of the invention and are not therefore to be considered limiting of its scope, the invention will be described and explained with additional specificity and detail through the use of the accompanying drawings in which.

DETAILED DESCRIPTION

Embodiments of the present invention are directed to a balance board system that enables a user to receive feedback while using a balance board. In some embodiments, this feedback could be a visual representation of a balance board in a virtual environment. In such embodiments, a balance board system may include a balance board, a phone that is mounted to the balance board, and an output device, such as a TV, on which the virtual environment can be displayed. In some embodiments, the feedback could also or alternatively be audible feedback. In embodiments where only audible feedback is generated, a balance board system may include only a balance board and a phone, or could include a balance board, phone, and a separate speaker. Embodiments of the present invention will be described with reference to balance board 100. However, a balance board system could be implemented with other balance boards. Also, the balance board system could be used to provide a gaming environment where the balance board can function as a gaming controller. In such gaming environments, the software on the phone can allow the user to generate inputs via the balance board for various games that can be portrayed in the virtual environment.

As an overview, the user may install software, such as a mobile application, on his or her phone to enable the phone to provide the functionality described herein. The term "phone" should be construed as encompassing smart phones as well as other similar devices such as a tablet, iPod, etc. The phone may be mounted to a balance board so that the phone may be used to detect the orientation of the balance board while the user uses the balance board.

In some embodiments, a phone mount may be provided to mount the phone to the balance board. In other embodiments, a balance board could be configured to receive a phone such as by including an integrated compartment. When the phone is mounted to the balance board, the software may generate a virtual environment in which a representation of the balance board is displayed in accordance with the orientation of the balance board. The virtual environment may be displayed on an output device, such as a TV, via casting, screen mirroring, or any other suitable technique.

Figure 1A:
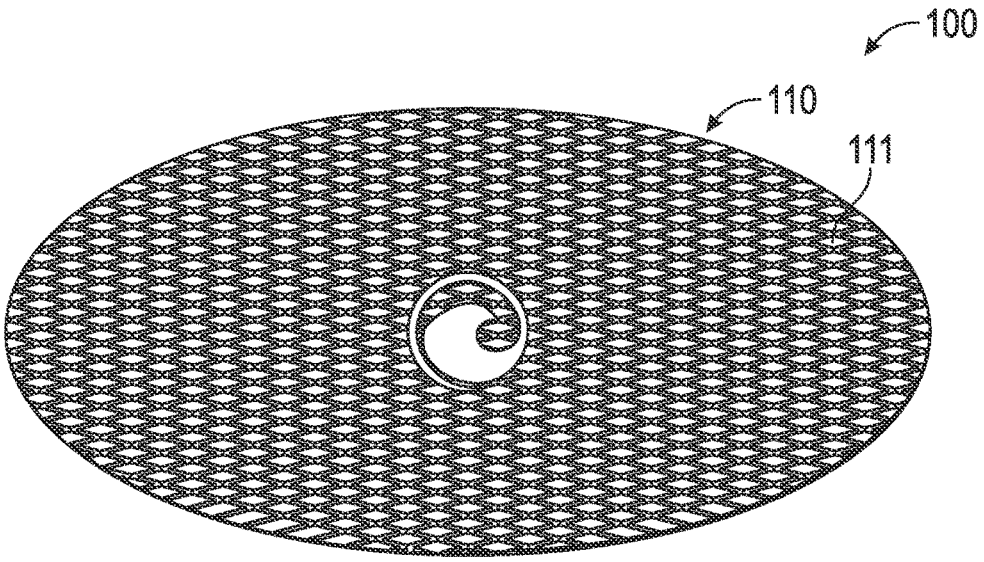
FIG. 1A (Prior Art)
FIGS. 1A-1C illustrate a prior art balance board with which a phone mount configured in accordance with one or more embodiments of the present invention could be used.
Figure 1B:
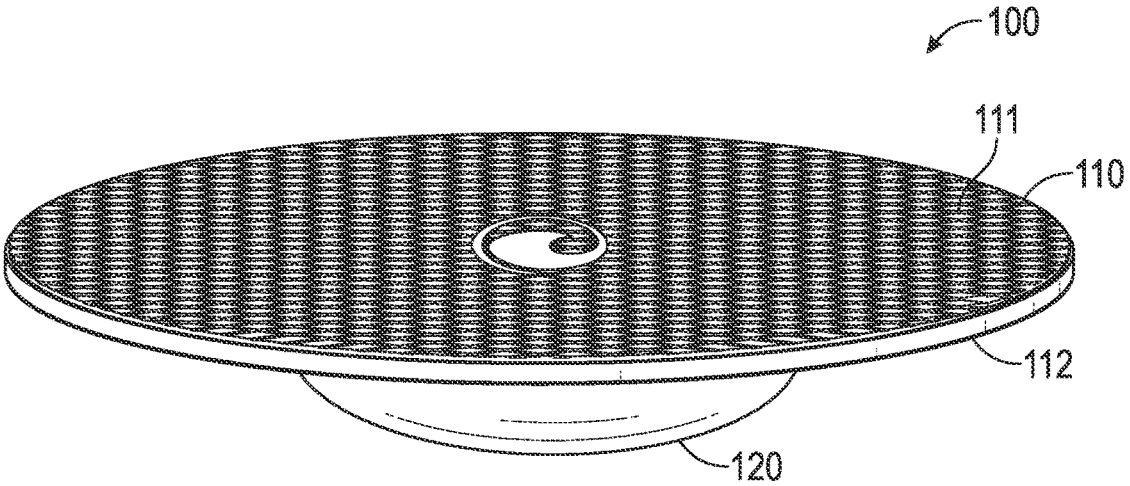
FIG. 1B (Prior Art)
Figure 1C:
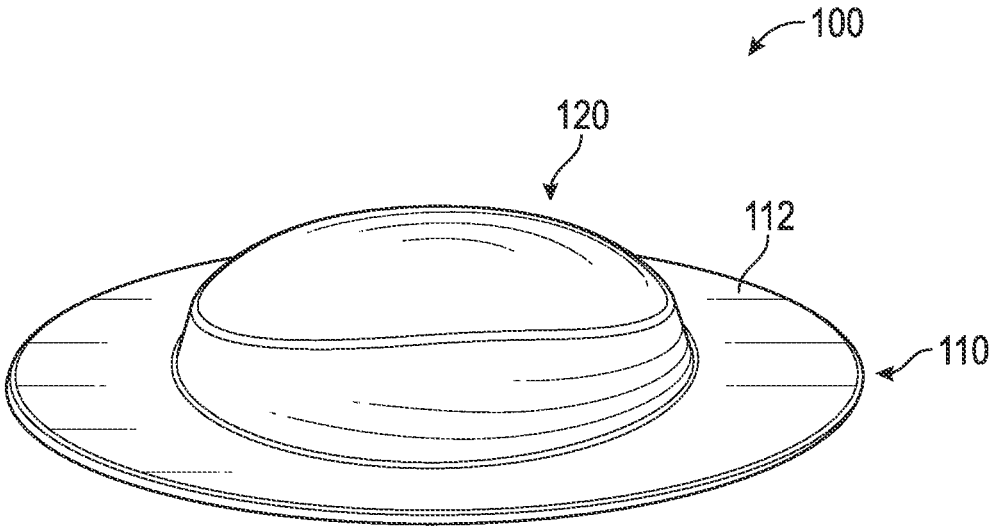
FIG. 1C (Prior Art)
Figure 2:
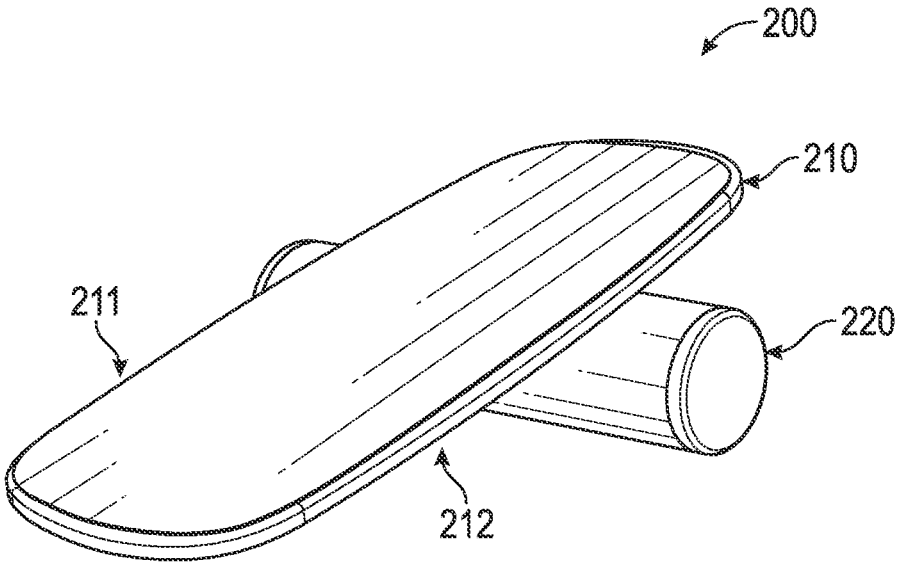
FIG. 2 (Prior Art)
FIG. 2 illustrates another prior art balance board with which a phone mount configured in accordance with one or more embodiments of the present invention could be used.
Figure 3B:
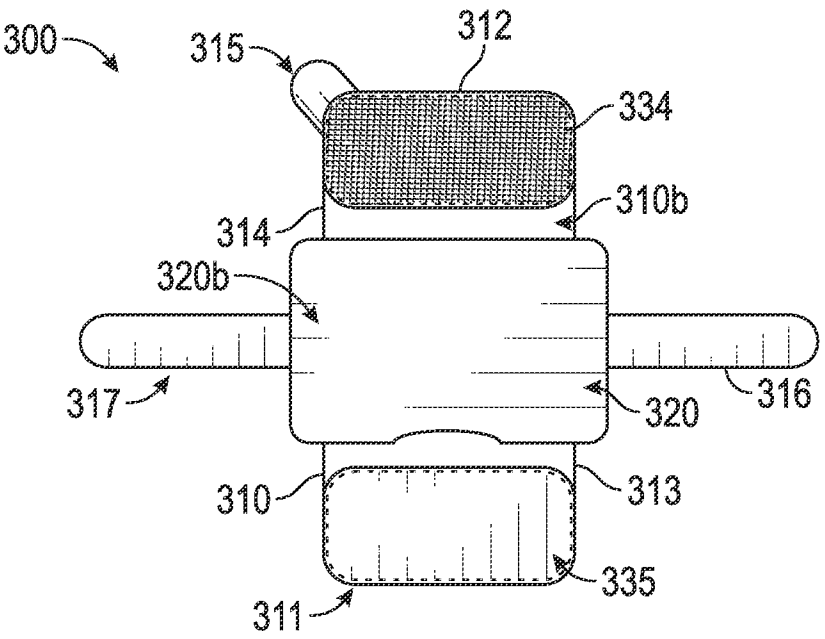
FIGS. 3A and 3B are bottom and top views respectively of a balance board phone mount that is configured in accordance with one or more embodiments of the present invention.
Figure 3A:
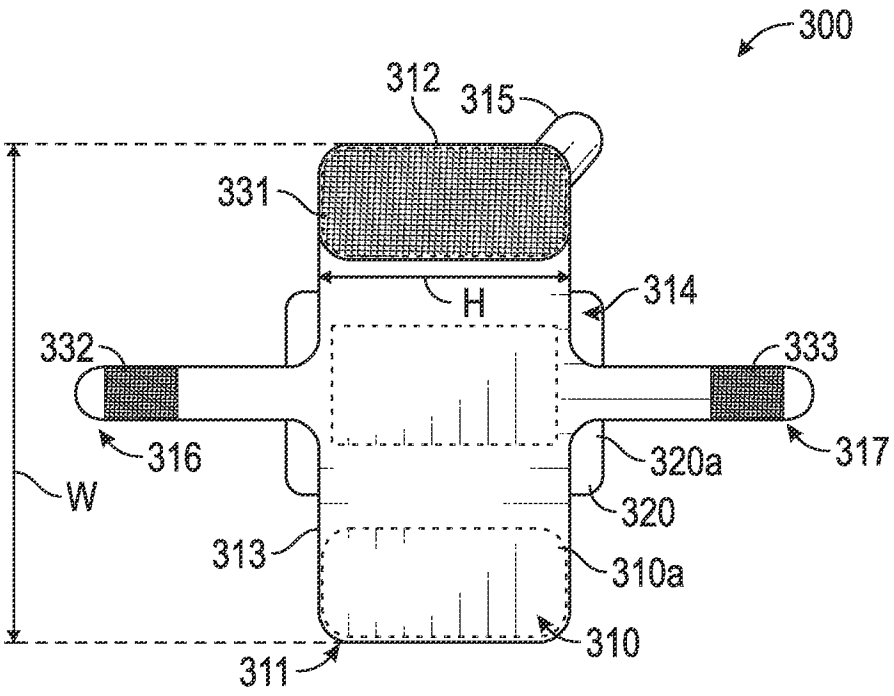

FIGS. 3A and 3B are bottom and top views respectively of a balance board phone mount 300 (or phone mount 300) that is configured in accordance with one or more embodiments of the present invention. In this context, "top" and "bottom" refer to the sides of phone mount 300 that would be oriented upwardly and downwardly respectively when phone mount 300 is secured to the bottom surface of the board of a balance board.

Phone mount 300 may include a body 310 having a bottom side 310*a* and a top side 310*b*. Body 310 may have a rectangular, square or other shape formed by a first side 311 and a second side 312 opposite first side 311 which define the width (W) of body 310, and a third side 313 and a fourth side 314 opposite third side 313 which define the height (H) of body 310. The width of body 310 may exceed the width of a phone with which phone mount 300 may be used and the height may or may not exceed the height of the phone. For example, the width may be sufficient so that, when a phone is placed on bottom side 310*a* of body 310, first side 311 may be folded over the phone and then second side 312 may be folded over and secured to first side 311.

Phone mount 300 may also include a first extension 316 of body 310 that extends from third side 313 and a second extension 317 of body 310 that extends from fourth side 314. First extension 316 and second extension 317 may be integral to body 310 or may be coupled to body 310. In the depicted embodiments, first extension 316 and second extension 317 are centered between first side 311 and second side 312. However, in other embodiments, one or both of first extension 316 and second extension 317 may be positioned towards first side 311 or towards second side 312. In the depicted embodiments, first extension 316 and second extension 317 extend perpendicular to third side 313 and fourth side 314. However, in other embodiments, one or both of first extension 316 and second extension 317 may extend from third side 313 and fourth side 314 respectively at an angle that is not perpendicular. Accordingly, first extension 316 and second extension 317 may extend from third side 313 and fourth side 314 in any manner that allows first extension 316 and second extension 317 to be folded over-top body 310.

In some embodiments, body 310 may further include a tab 315 that extends from second side 312. In the depicted embodiments, tab 315 extends from the corner formed by second side 312 and fourth side 314. In other embodiments, tab 315 or another tab may extend from the corner formed by second side 312 and third side 313. In other embodiments, tab 315 or another tab may extend only from a portion of third side 313 or a portion of fourth side 314 that is towards second side 312.

Phone mount 300 may further include a number of fasteners 331-335 (collectively fasteners 330). In the depicted embodiments, fasteners 330 are in the form of hook and loop fasteners. In other embodiments, fasteners 330 may be in the form of magnets, adhesives or another material. Fastener 331 may be positioned on bottom side 310*a* of body 310 at second side 312. Fastener 332 and fastener 333 may be positioned on bottom side 310*a* at or towards the ends of first extension 316 and second extension 317 respectively. Fastener 334 and fastener 335 may be positioned on top side 310*b* of body 310 at second end 312 and first end 311 respectively.

Phone mount 300 may additionally include a base 320 having a bottom side 320*a* and a top side 320*b*. Bottom side 320*a* may be coupled to top side 310*b* of body 310. Top side 320*b* may include an adhesive material to thereby allow top side 320*b* to be adhered to the bottom side of the board of a balance board. For example, top side 320*b* could be in the form of an adhesive tape that includes a protective film. In other embodiments, top side 320*b* could be configured with hook and loop material or magnetic material if the board of a balance board is appropriately configured. Phone mount 300 may also be fixed to the balance board via screws. In some embodiments, base 320 may be formed as part of body 310 as opposed to being a separate component that is coupled to body 310.

In the depicted embodiments, base 320 has a rectangular shape that is oriented perpendicular to the rectangular shape of body 310 such that portions of base 320 extend beyond third side 313 and fourth side 314. In some embodiments, the shape and size of base 320 may correlate with the shape and size of a phone with which phone mount 300 may be used. For example, the dimensions of base 320 may generally match or exceed the dimensions of the phone. In other embodiments, however, base 320 could have a different shape and/or different size. In short, base 320 may have any suitable shape or size that will ensure that phone mount 300 remains secured to the bottom of the board of a balance board.

Figure 4A:
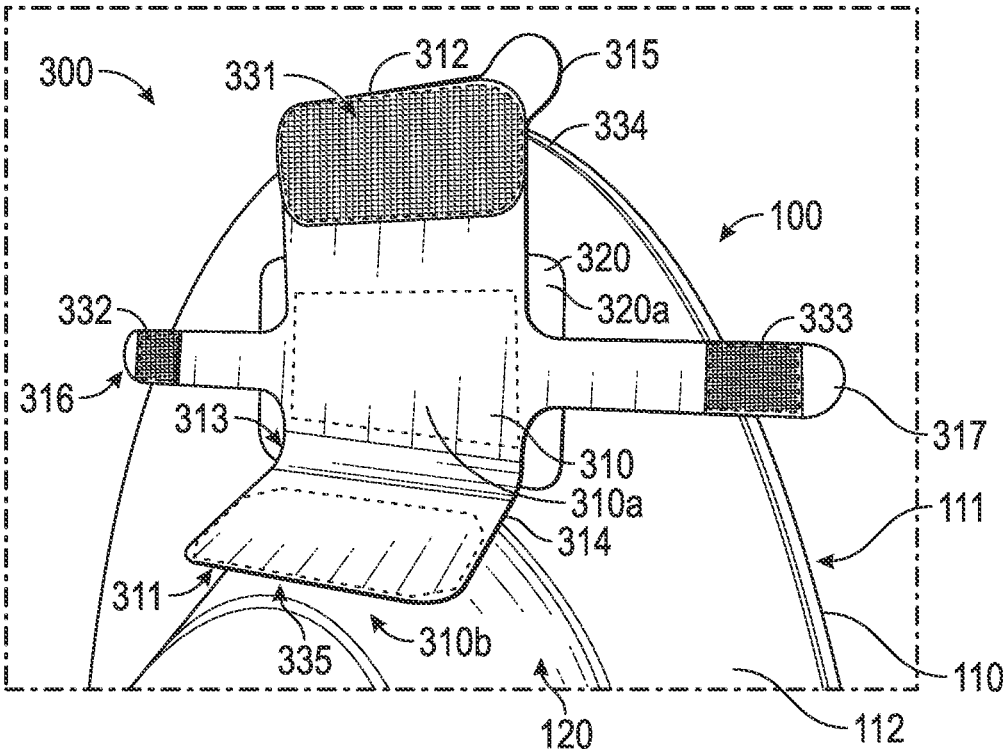
FIGS. 4A-4C illustrate how a phone mount that is configured in accordance with one or more embodiments of the present invention could be used to mount a phone to the balance board of FIGS. 1A-1C.
Figure 4B:
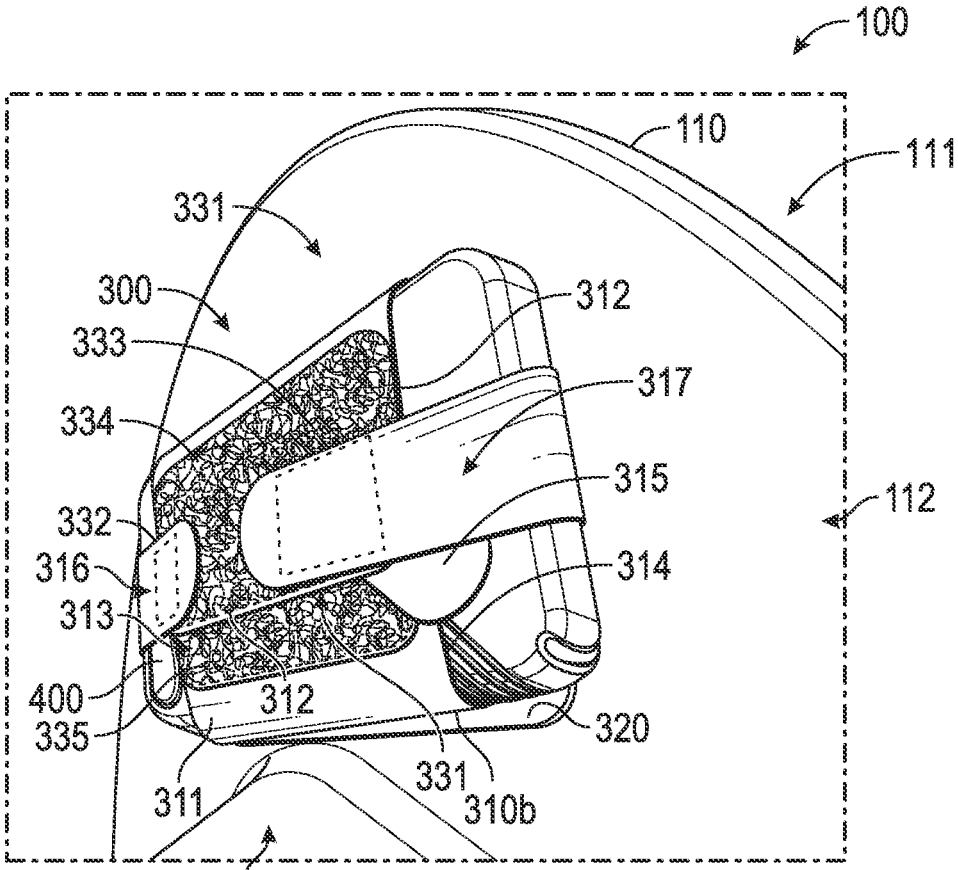
Figure 4C:
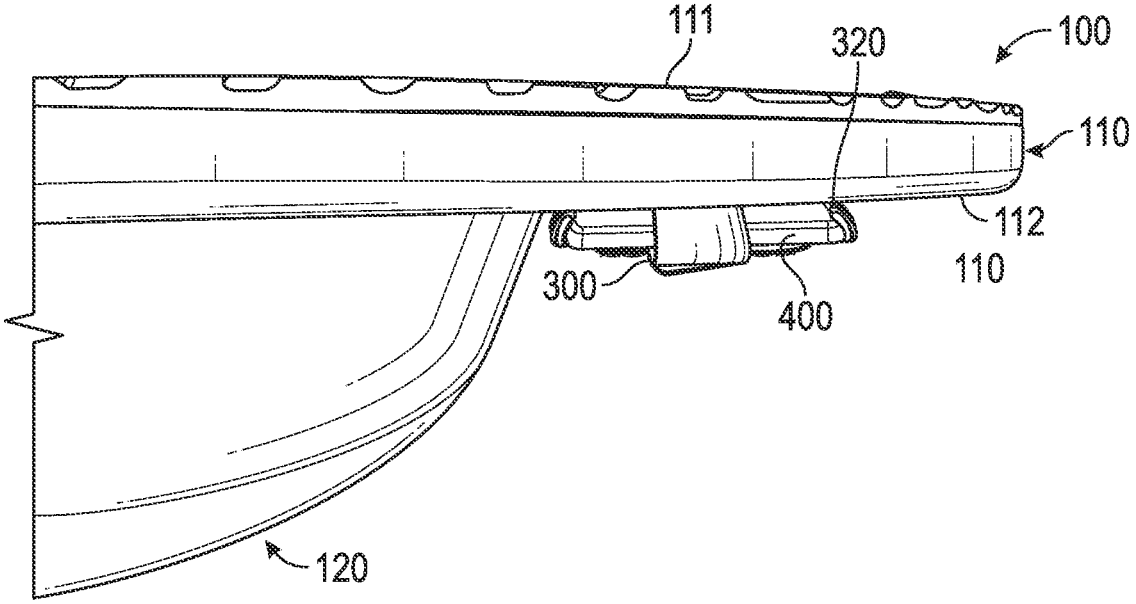

FIGS. 4A-4C illustrate how phone mount 300 may be used with balance board 100 in accordance with one or more embodiments of the present invention. With reference to FIG. 4A, top side 320*b* of base 320 has been adhered to bottom 112 of board 110. Turning to FIG. 4B, a phone 400 has been secured within phone mount 300 to thereby mount phone 400 to bottom 112 of board 110. To secure phone 400 within phone mount 300, a user can place phone 400 on/against bottom side 310*a* of body 310 and then fold first side 311 overtop phone 400. With first side 311 folded overtop phone 400, the user could then fold second side 312 overtop first side 311 to adhere fastener 331 to fastener 335. The width (W) of body 310 can be sufficient to accommodate phones of varying widths. In other words, the width can be sufficient to ensure that fastener 335 will overlap with fastener 331 when second side 312 is folded overtop first side 311 whenever a typically-sized phone is placed on/against bottom side 310*a*.

With second side 312 secured to first side 311 via fasteners 331 and 335, the user can then fold first extension 316 and second extension 317 overtop second side 312 to cause fasteners 332 and 333 to adhere to fastener 334 or possibly to fastener 335. As a result, phone 400 will be secured on all four sides by first side 311, second side 312, first extension 316 and second extension 317.

In the depicted embodiments, fasteners 332 and 333 are spaced away from the ends of first extension 316 and second extension 317 respectively so that the ends of first extension 316 and second extension 317 can function as tabs for pulling fasteners 332 and 333 away from fastener 334 to thereby separate first extension 316 and second extension 317 from second side 312. Similarly, tab 315 can be used to pull fastener 331 away from fastener 335 to thereby separate second side 312 from first side 311.

FIG. 4C shows how phone mount 300 enables phone 400 to be mounted to bottom 112 of board 110 so that phone 400 can be used to detect and monitor motion of balance board 100. Notably, by mounting phone 400 to bottom 112, phone 400 will not obstruct any portion of top 111 where the user stands. Also, phone mount 300 can be secured to bottom 112 towards fulcrum 120 so that phone 400 will be protected from contacting the floor. As described in further detail below, because phone 400 is mounted to bottom 112, software on phone 400 can employ the circuitry of phone 400 to accurately detect the orientation and movement of board 110. The software could therefore monitor how well the user is maintaining his or her balance or performing a particular trick, movement or technique on balance board 100 or any other balance board.

Figure 5:
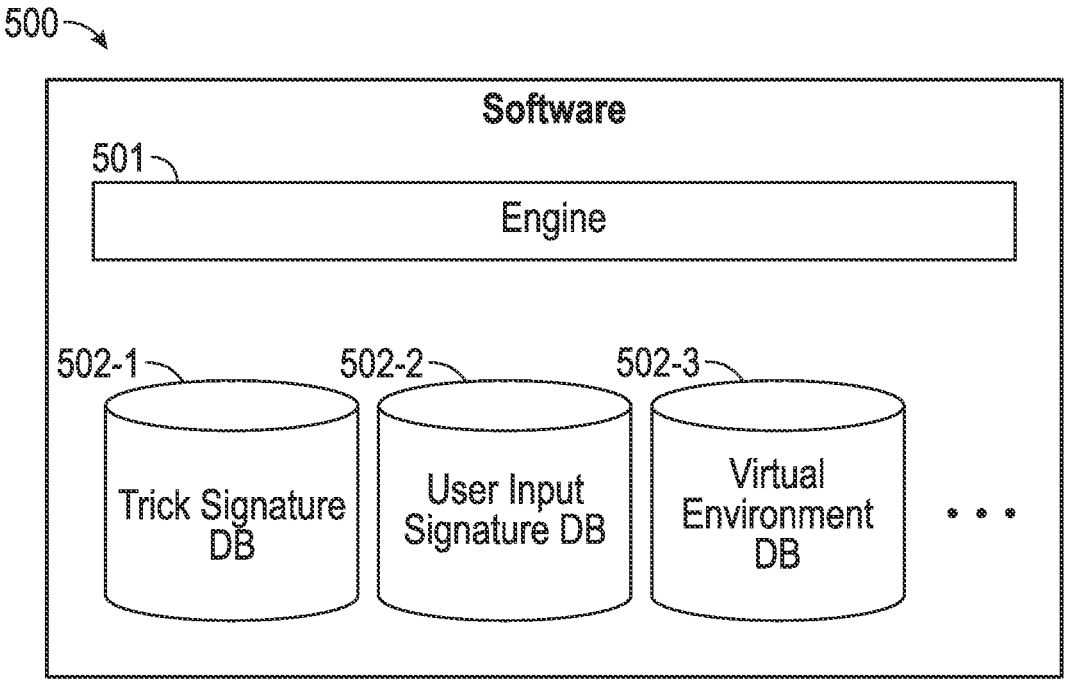
FIG. 5 is a block diagram of software that may be employed in embodiments of the present invention.

FIG. 5 is a block diagram of software 500 that may be used to implement embodiments of the present invention. Software 500 could be a mobile application that the user could install on his or her phone or any other suitable type of software. Software 500 may include an engine 501, a trick signature database 502-1, a user input signature database 502-2 and a virtual environment database 502-3, among possibly other databases. The term "database" should be construed as encompassing any data structure that may store the data described herein. Also, any number of databases could be used to maintain the data described herein, and the depicted separation of databases is for illustrative purposes only.

Engine 501 can represent any suitable configuration and/or arrangement of computer executable instructions for performing the functionality described herein. For example, engine 501 could include one or more modules for generating user interfaces, one or more modules for receiving orientation data from one or more sensors of the phone (e.g., one or more accelerometers, gyroscopes, magnetometers, etc.), one or more modules for processing the orientation data to detect signatures, one or more modules for rendering a virtual environment, one or more modules for mapping input data to a game's avatar, etc.

To use a balance board system configured in accordance with embodiments of the present invention, a user may launch software 500 on his or her phone typically before mounting the phone to balance board 100. Software 500 may allow the user to select a particular mode of operation. Once the user selects a mode, the user can mount the phone to balance board 100, such as via phone mount 300 as described above, to allow software 500 to generate a virtual environment in which the orientation of balance board 100 can be simulated as the user rides it.

Figures 6A, 6B:
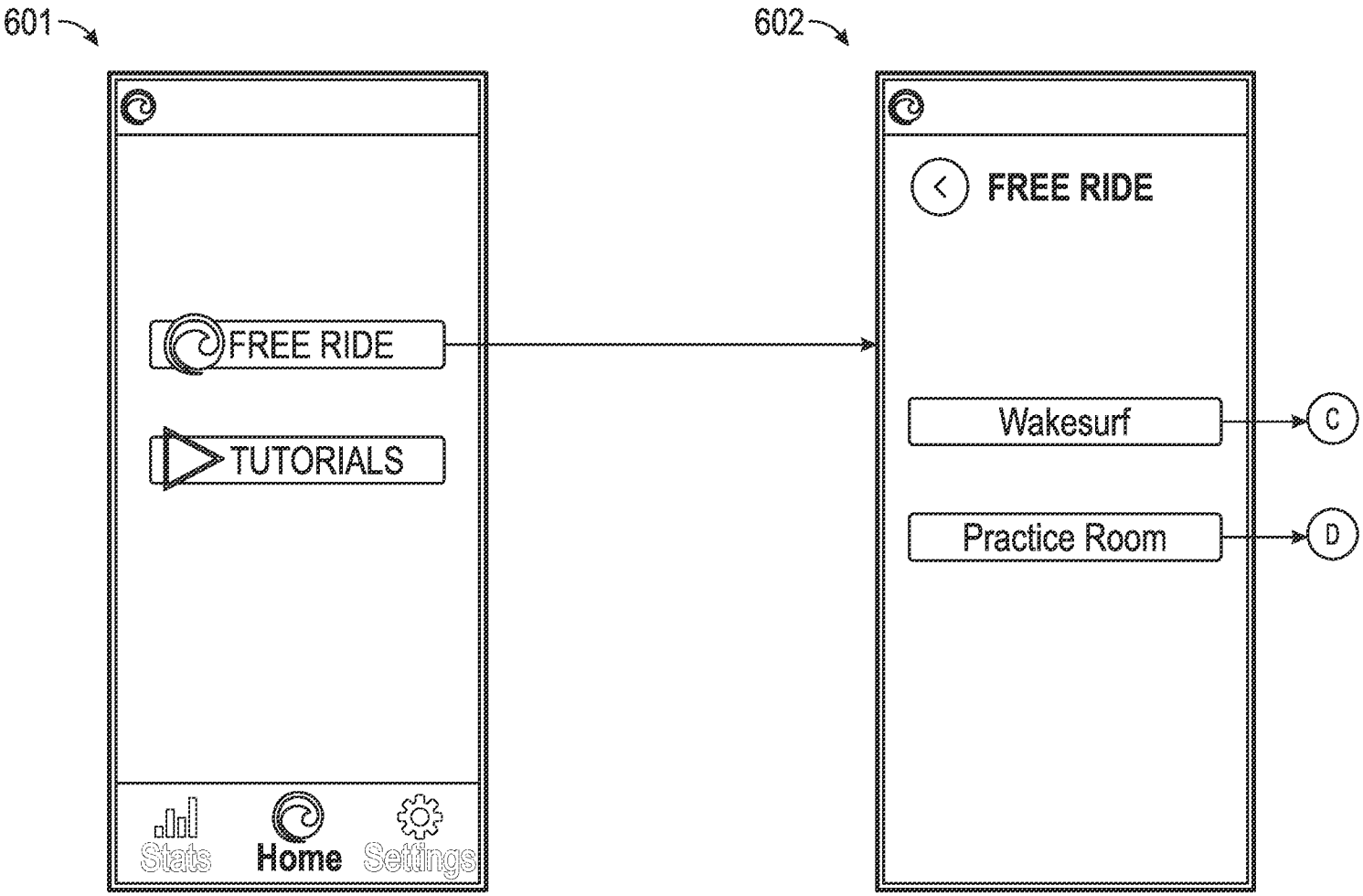
FIGS. 6A and 6B are example user interfaces that the software may provide to allow a user to practice wakeboarding, wakesurfing, snowboarding, ocean surfing or other balance board activities in a virtual environment.
Figure 6C:
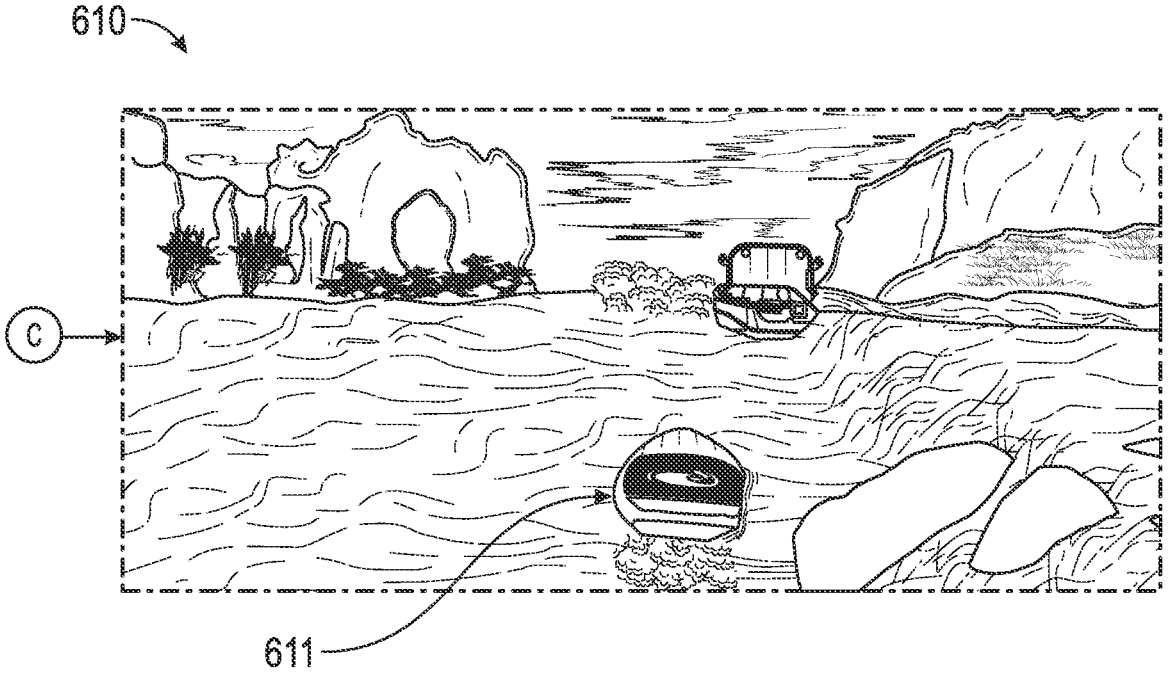
FIGS. 6C and 6D are examples of virtual environments that the software may create.
Figure 6D:
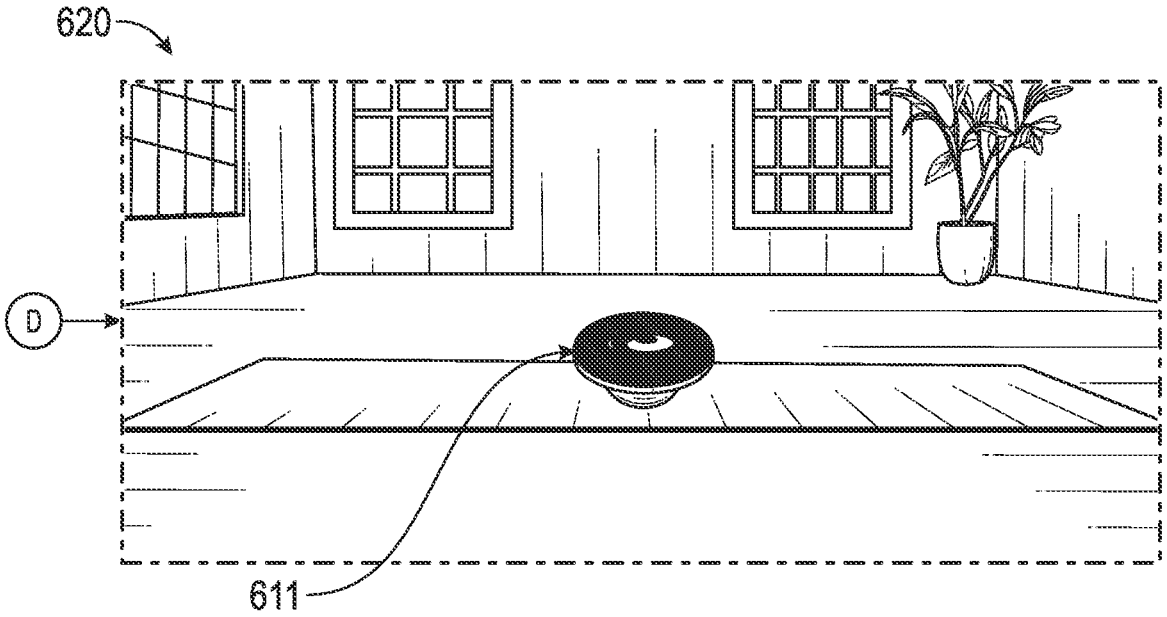

FIG. 6A shows an example user interface 601 that software 500 may provide to allow the user to select a mode of operation. In the depicted embodiments, there are two modes: free ride and tutorials. FIG. 6B shows an example user interface 602 that software 500 may display when the user selects the free ride option. User interface 602 includes an option to free ride in a wakesurf virtual environment 610 (FIG. 6C) and an option to free ride in a practice room virtual environment 620 (FIG. 6D).

Wakesurf virtual environment 610 includes a body of water in which a boat is travelling to create a wake. A representation 611 of balance board 100 is included in wakesurf virtual environment 610. In this example, representation 611 is in the form of a wakeboard. As described in greater detail below, engine 501 can orient representation 611 in wakesurf virtual environment 610 based on the orientation of balance board 100, or more specifically, the orientation of board 110. Accordingly, representation 611 can mirror balance board 100 as the user rides it. Practice room virtual environment 620 may be an image of a room or other environment in which representation 611 appears. In the depicted example, the image of the room is static. However, in some embodiments, the image of the room could be dynamically updated. In this example, representation 611 is in the form of balance board 100. Again, engine 501 can orient representation 611 in practice room virtual environment 620 based on the orientation of balance board 100.

In some embodiments, software 500 may provide multiple wakesurf virtual environments and/or multiple practice room virtual environments. For example, the user may have the option of virtually wakesurfing in a variety of locations around the world. Likewise, the user may have the option of practicing the balance board in a variety of settings.

Figures 7A, 7B, 7C:
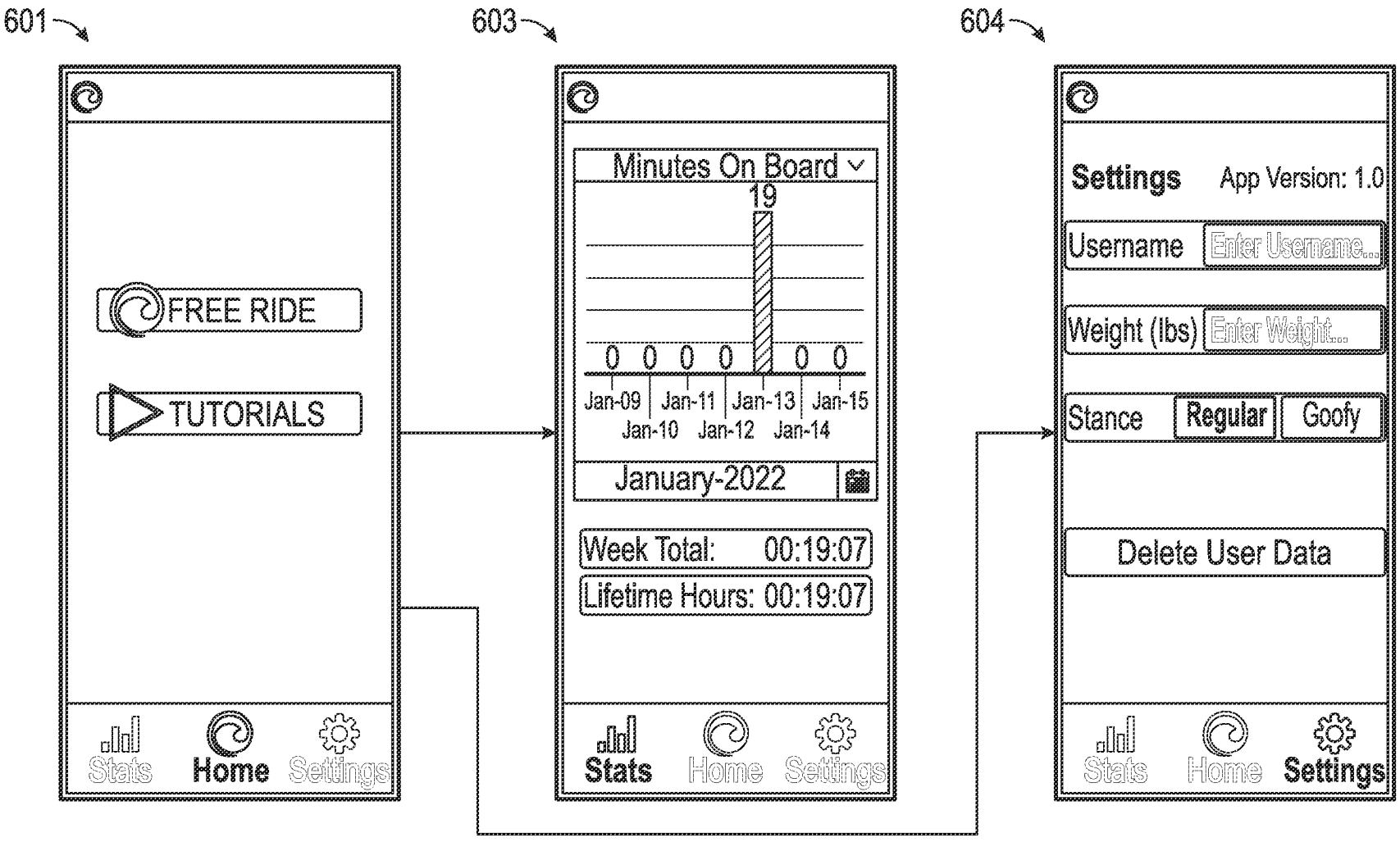
FIGS. 7A-7C are example user interfaces that the software may provide to allow the user to view statistics and settings.

FIGS. 7A-7C provide additional examples of user interfaces that software 500 may provide. FIG. 7A again shows user interface 601 which provides an option to view statistics and settings. FIG. 7B shows an example user interface 603 in which the user's statistics may be displayed. These statistics may include an amount of time that the user has used the balance board system during various time periods. Of course, other statistics could be provided such as which tricks the user has completed, a number of times the user has completed tricks, calories burned, etc. FIG. 7C shows an example user interface 604 in which the user may adjust settings for software 500. These settings could include a username, a weight, a stance, etc. In some embodiments, software 500 could use these settings to adjust how representation 611 appears and/or to otherwise adjust software 500's functionality.

Figure 8B:
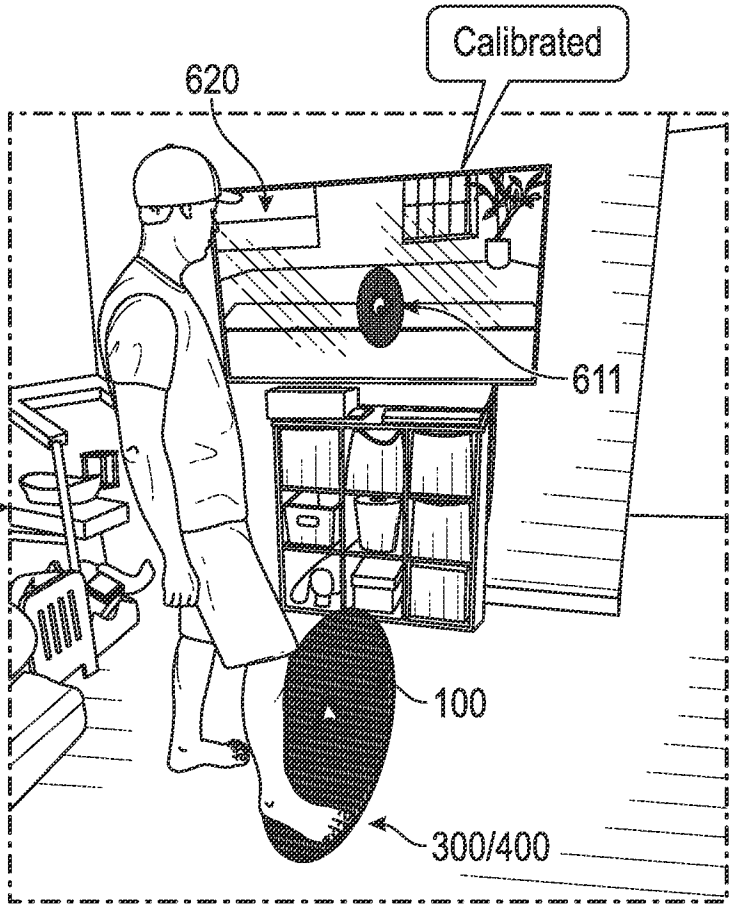
FIGS. 8A and 8B illustrate how the software allows a user to calibrate a phone when attached to a balance board.
Figure 8A:
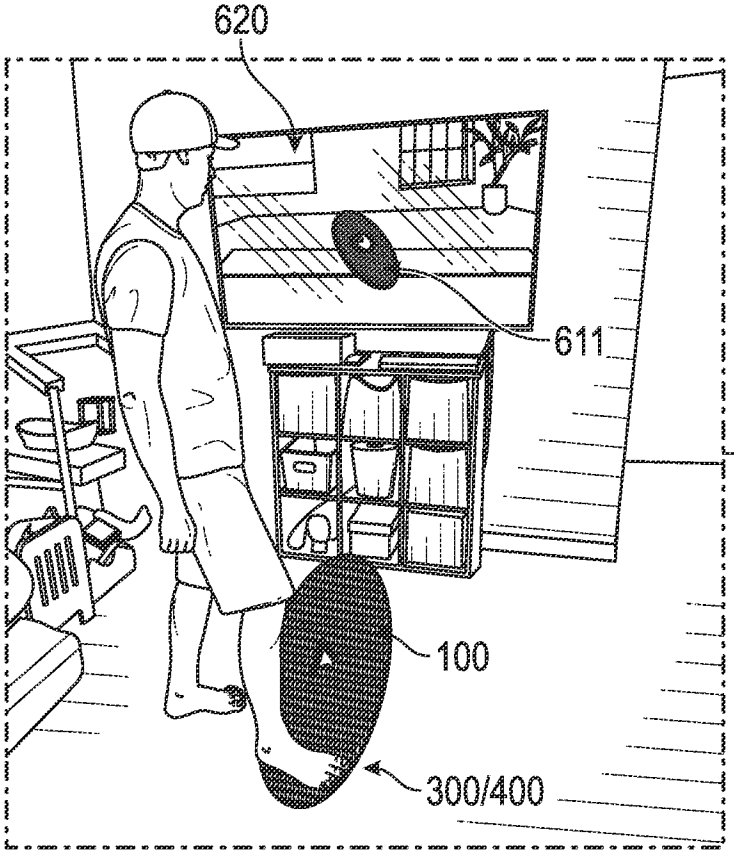

FIGS. 8A and 8B provide an example of how a balance board system may be calibrated in one or more embodiments of the present invention. In this example, the user has selected the option to free ride in virtual room environment 620, has configured phone 400 to mirror its display to a TV, and has mounted phone 400 to balance board 100 using phone mount 300.

As shown in FIG. 8A, engine 501 may initially display representation 611 based on the orientation of balance board 100 with a default "offset." In other words, software 500 will not initially know where the TV (or other display) is relative to balance board 100 (or more accurately, relative to phone 400 which is mounted to balance board 100), and therefore representation 611 may not be aligned with the actual orientation of balance board 100. To address this issue, software 500 can be configured to allow the user to calibrate the balance board system. In this context, calibration means enabling software 500 to know when balance board 100 is pointed towards the TV so that the proper offset can be used when orienting representation 611 within the virtual environment.

In some embodiments, such as is represented in FIGS. 8A and 8B, software 500 may allow the user to calibrate the balance board system by orienting balance board 100 towards the TV and holding the rear end of balance board 100 (i.e., the end on which phone 400 is mounted) against the ground for a threshold amount of time (e.g., 3 seconds). More specifically, software 500 can be configured to detect when phone 400 is tilted rearwardly at a specific angle—the angle of balance board 100 when its rear end is against the ground—for the threshold amount of time. Upon detecting this occurrence, software 500 can use the current orientation data (e.g., current values obtained from phone 400's sensors) to determine a value for the offset. This offset can then be applied to orientation data when using the orientation data to determine how representation 611 should be oriented in the virtual environment. For example, in FIG. 8B, even though balance board 100 has not been moved, representation 611 has been reoriented in practice room virtual environment 620 to match the orientation of balance board 100. This calibration process could be repeated at any time such as when the user may move the balance board.

In some embodiments, engine 501 may be configured to provide feedback to the user during the calibration process. For example, if the user forces the rear end of balance board 100 against the ground, engine 501 may detect that balance board 100 is in the calibration angle and may provide an audible indication that the calibration process has started. This audible indication could be repeated until the threshold amount of time has elapsed at which point engine 501 could audibly output "calibrated" or some other indication that the calibration has been completed. By providing an audible indication that the calibration process is being performed, the user may be notified of and may cease an unintended calibration.

FIGS. 9A-9D provide examples of a tutorial virtual environment 901 that engine 501 may present to the user. Tutorial virtual environment 901 can include a number of tutorial segments which include video content of an expert performing tricks. Tutorial virtual environment 901 can also include representation 611 of balance board 100. By including representation 611 next to the video content, the use can easily see whether representation 611's orientation matches the orientation of the expert's balance board.

Figure 9A:
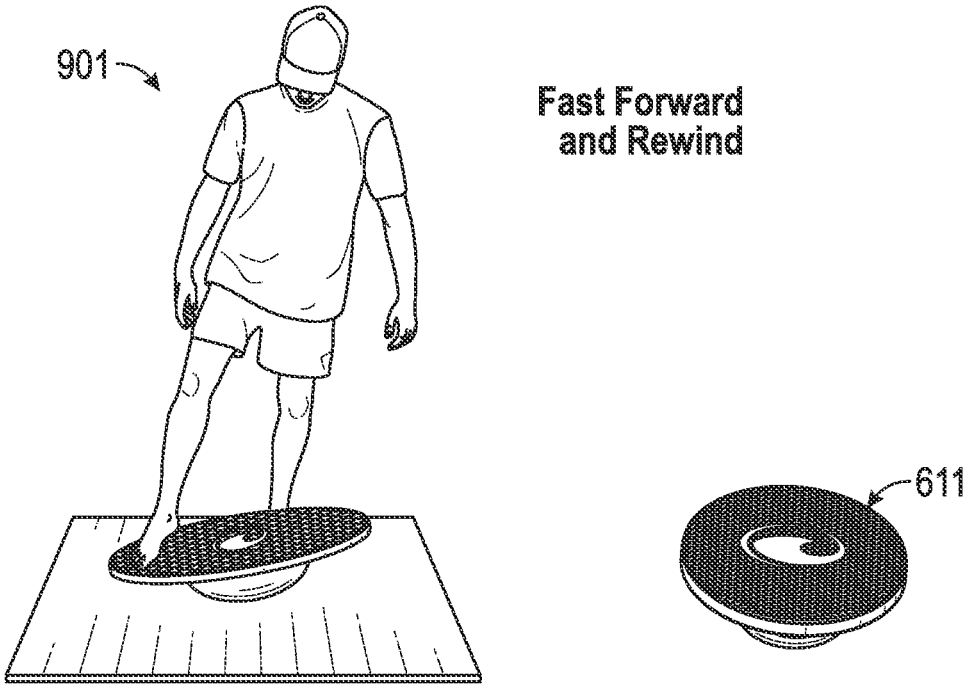
FIGS. 9A-9D provide examples of a virtual environment that may be used to provide tutorials.
Figure 9B:
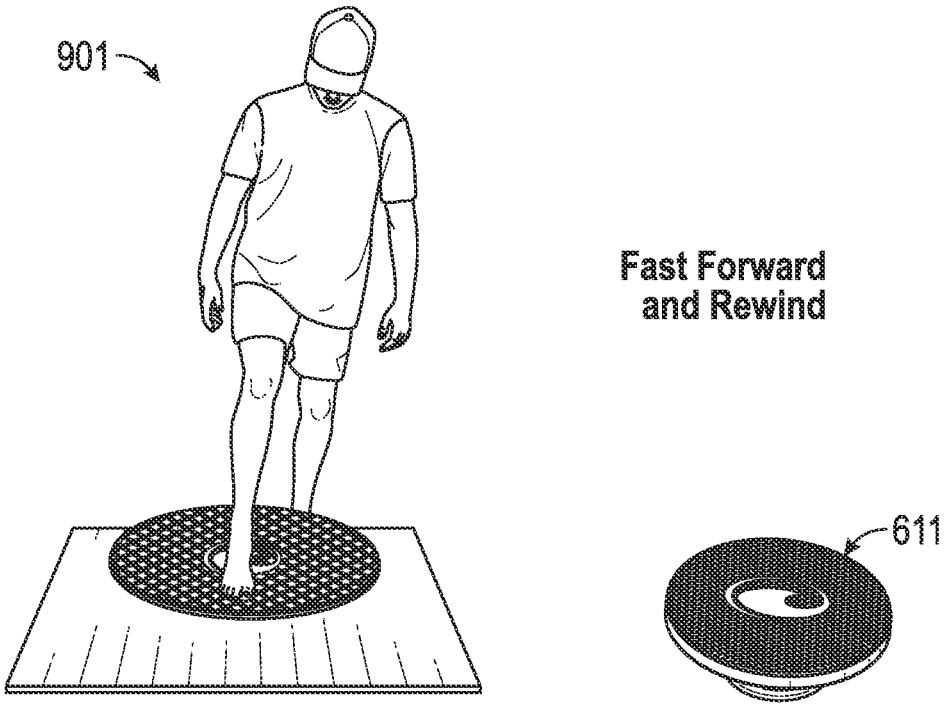
Figure 9C:
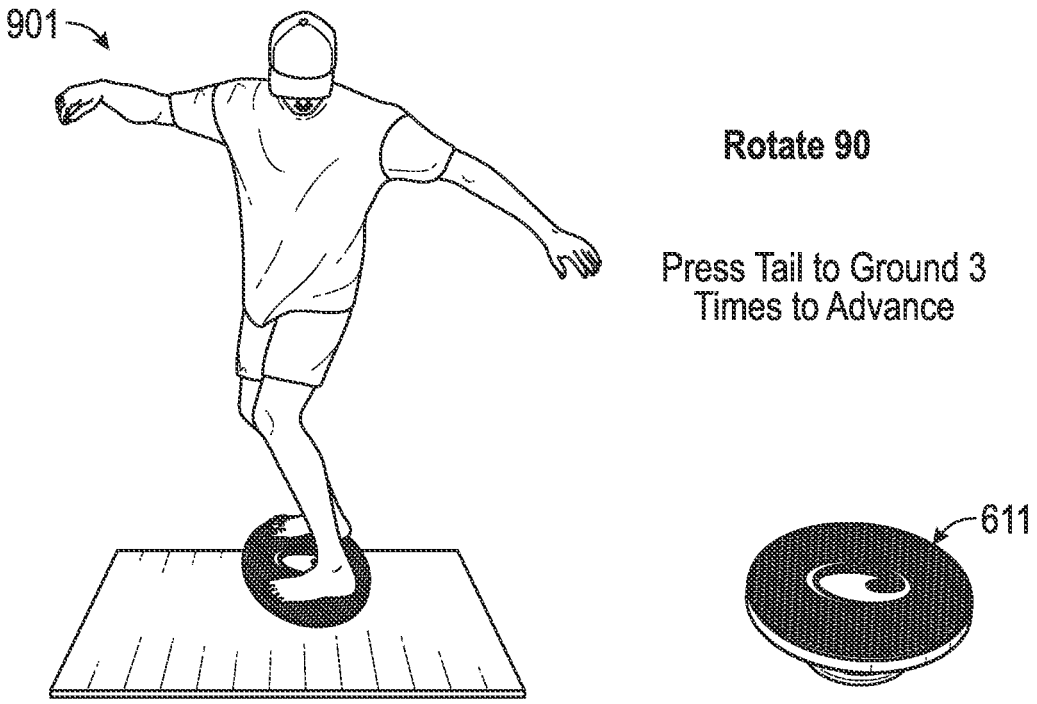
Figure 9D:
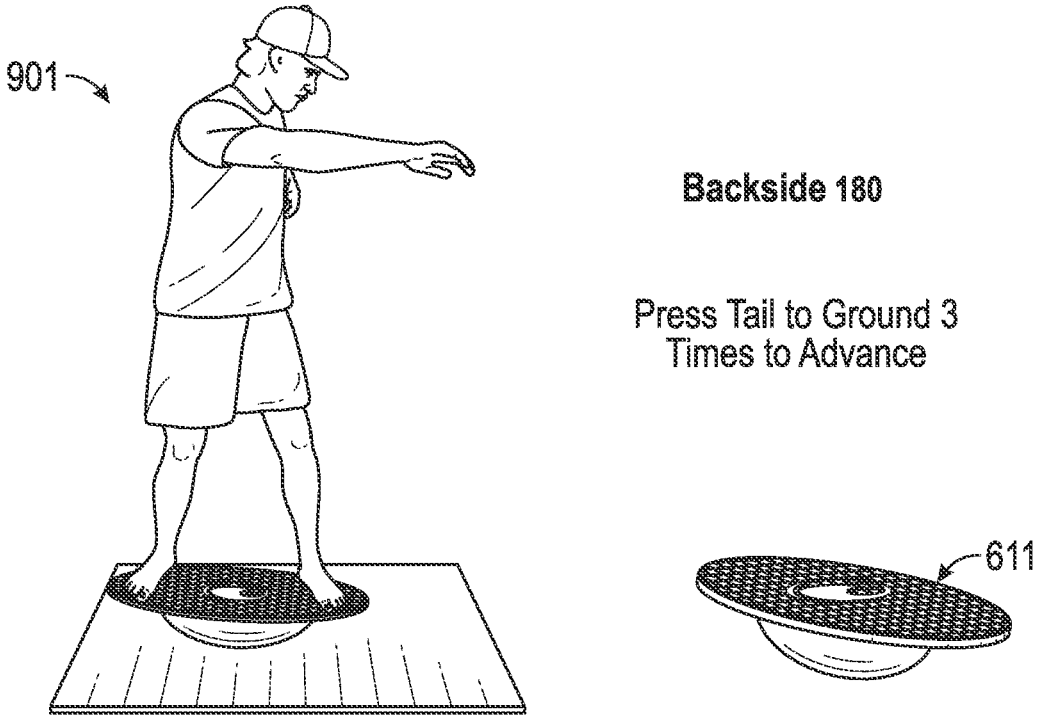

In some embodiments, engine 501 may be configured to allow the user to provide input for controlling tutorial virtual environment 901 or another virtual environment. For example, engine 501 could be configured to detect when the user moves balance board 100 in a particular sequence to fast forward or rewind the tutorial. FIG. 9A provides an example where the tutorial instructs the user to repeatedly press down on the rear end of balance board 100 (e.g., three consecutive times) to fast forward the tutorial to the next skill. FIG. 9B provides an example where the tutorial instructs the user to repeatedly press down on the toe side of balance board 100 (e.g., three consecutive times) to rewind the tutorial to the previous skill. Of course, engine 501 could be configured to detect any other suitable sequence or movement of balance board 100 for purposes of enabling the user to provide user input while phone 400 is mounted to balance board 100.

Figure 10:
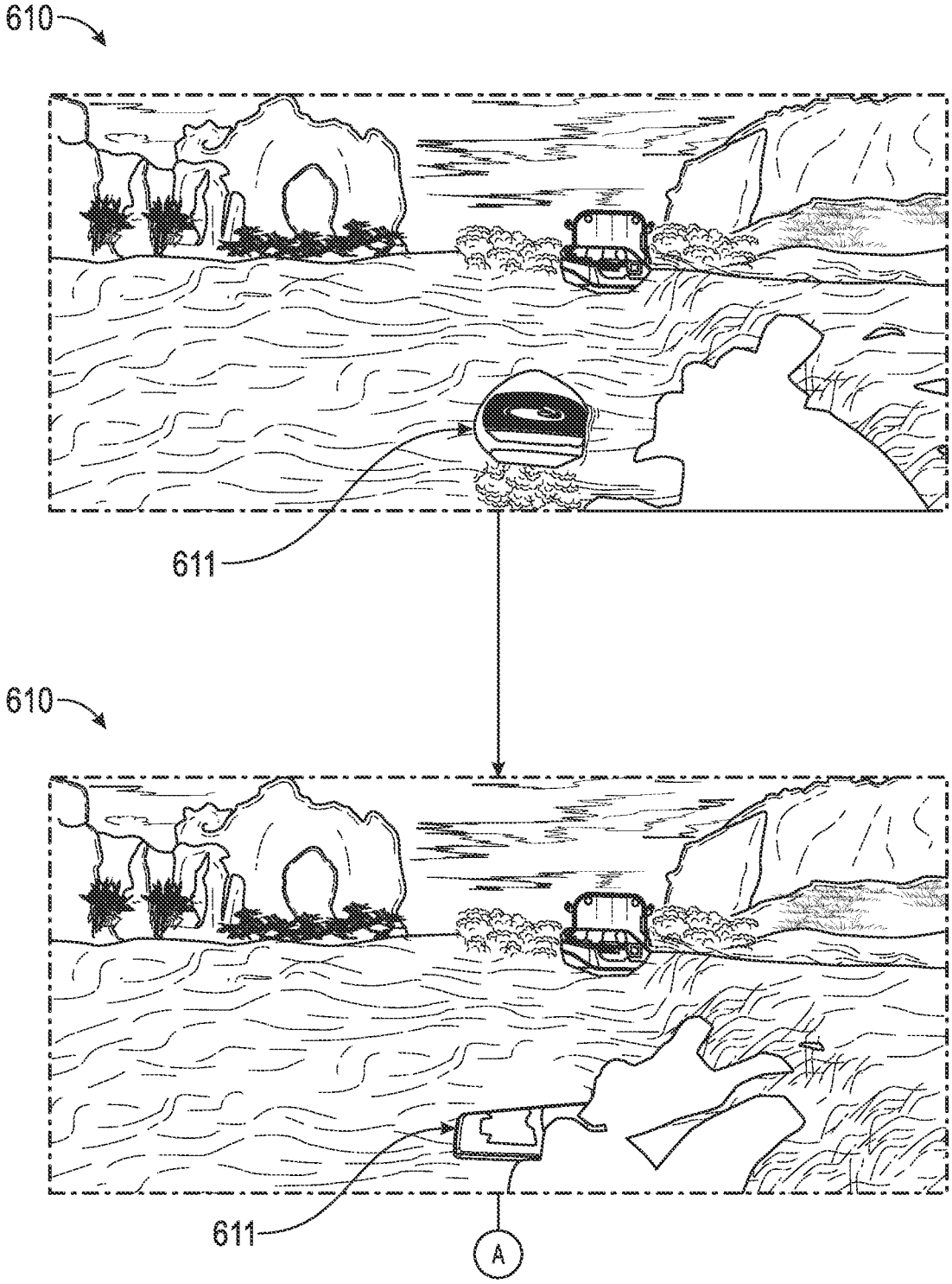
FIG. 10 represents how feedback can be given in a virtual environment when a user performs a trick or other activity on a balance board.
Figure 10:
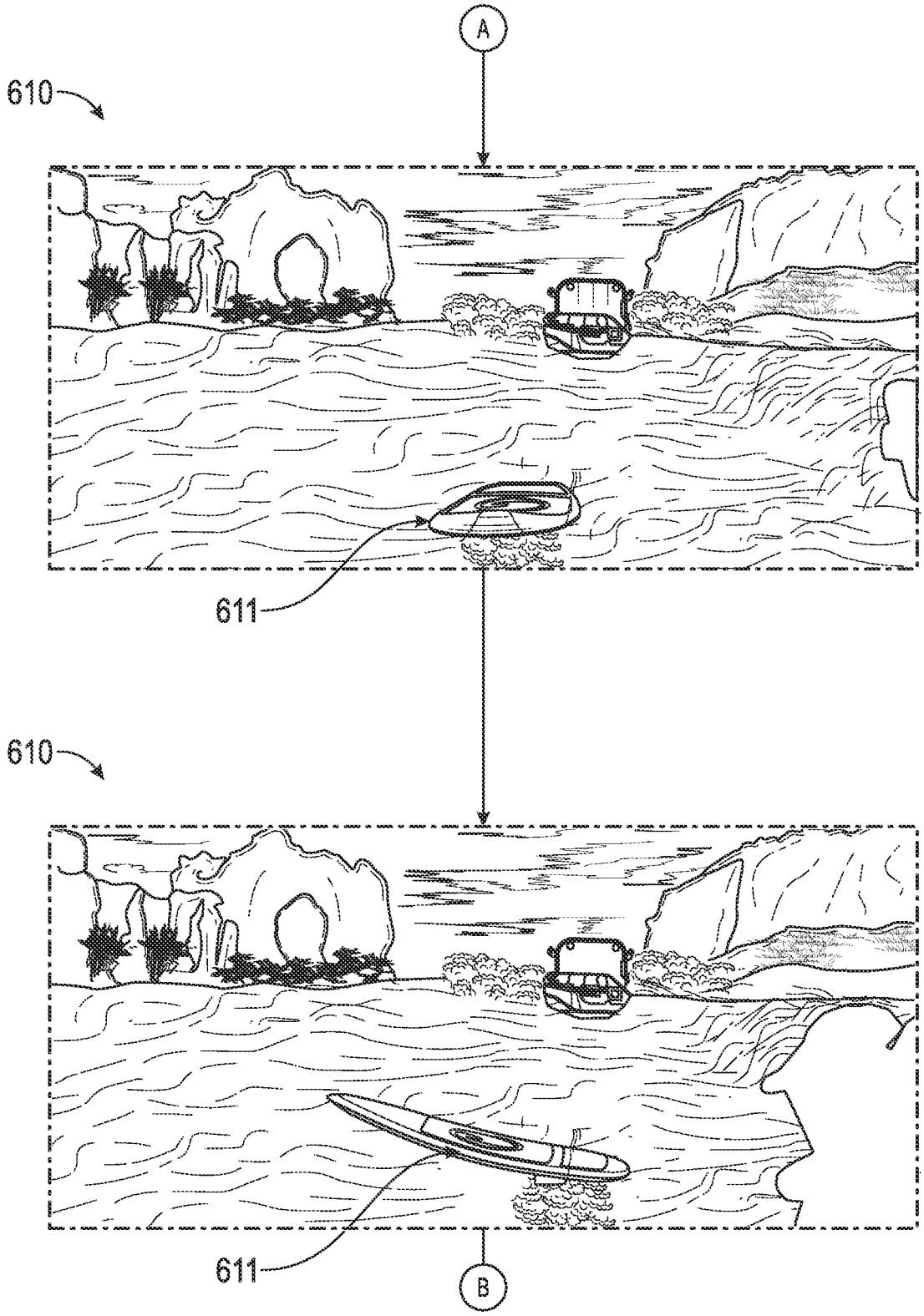
Figure 10:
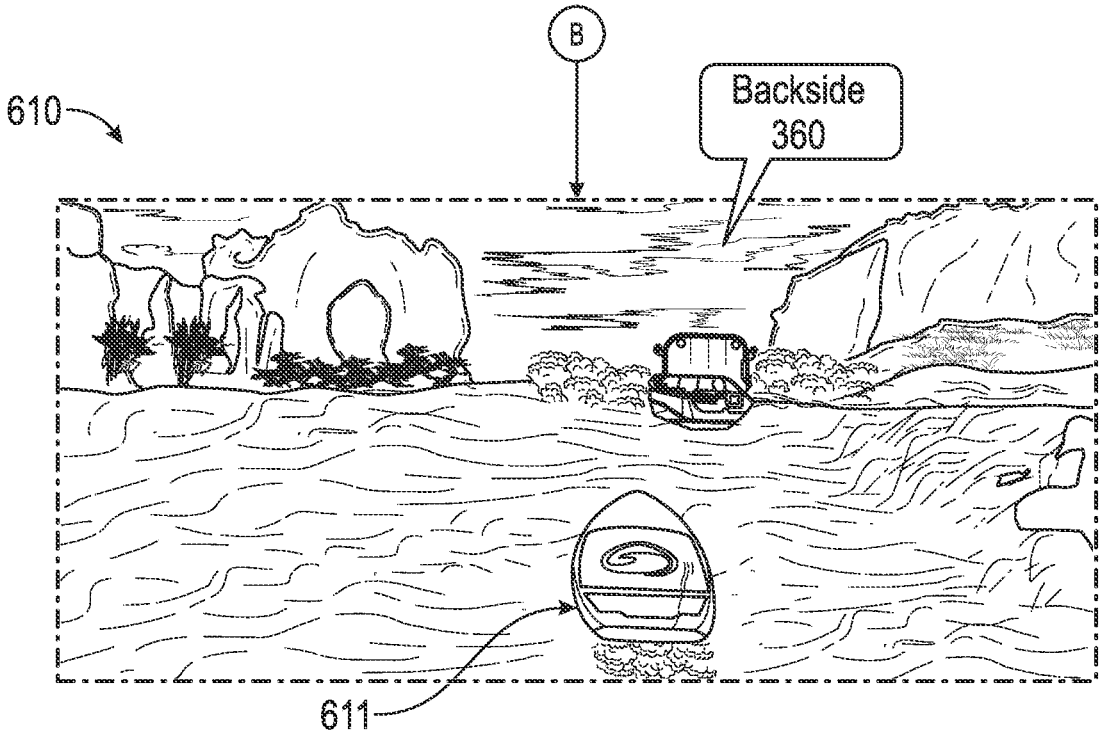

FIG. 10 provides an example of how engine 501 can update the orientation of representation 611 in wakesurf virtual environment 610 based on the orientation of balance board 100. FIG. 10 depicts a sequence in which the user performs a backside 360 on balance board 100. As described in greater detail below, engine 501 can obtain orientation data from phone 400's sensor(s) as balance board 100 moves and can use such orientation data to update the orientation of representation 611. In some embodiments, engine 501 can also determine, from the sequence of orientation data, that the user has completed a trick. In such embodiments, engine 501 may provide feedback such as by generating an audible output of "backside 360" to confirm that the user successfully completed the trick.

Figure 11:
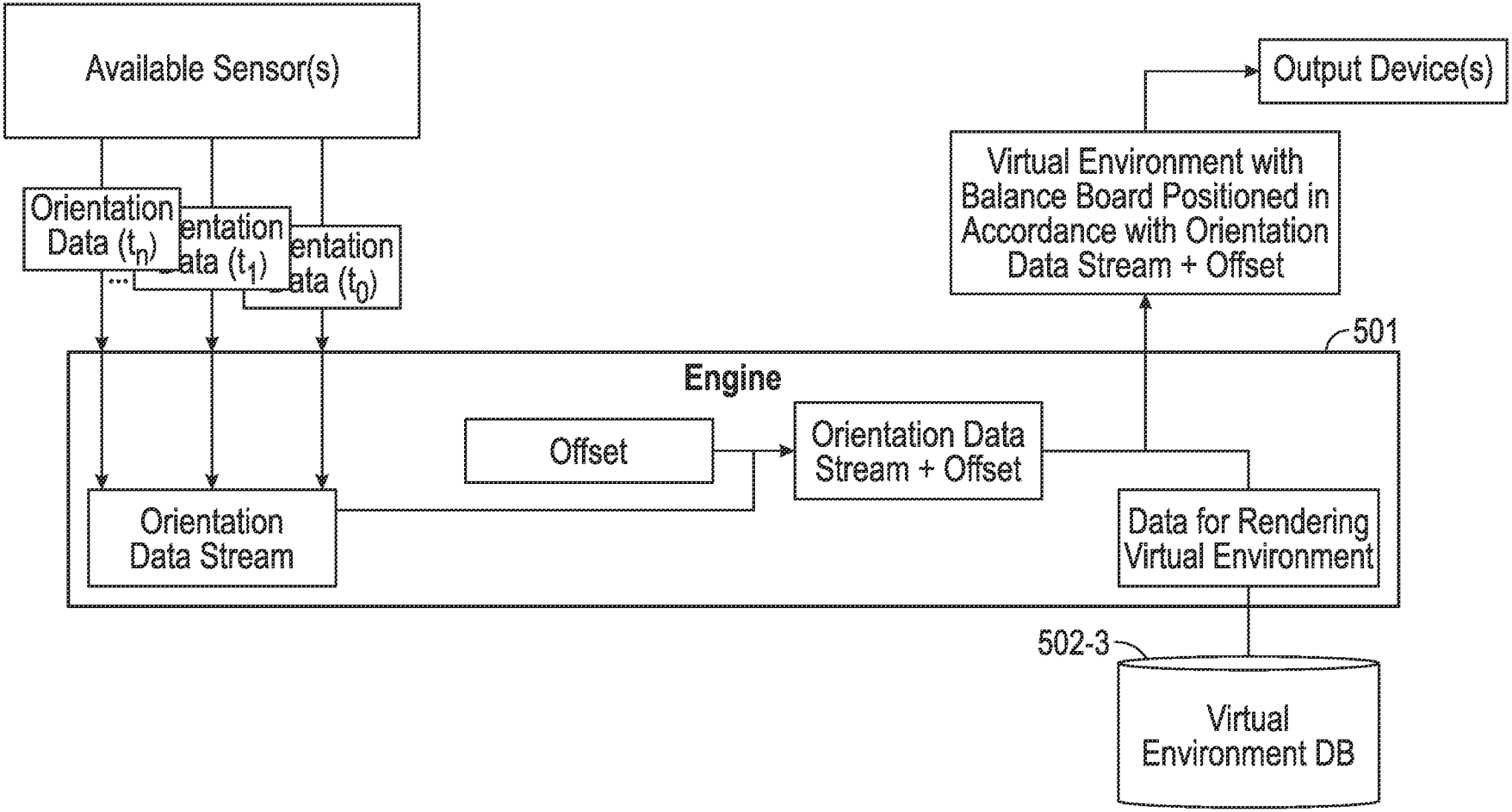
FIG. 11 represents how the software can generate a virtual environment that includes a representation of a balance board to which a phone is attached.

FIG. 11 provides an example of how software 500 may generate a virtual environment that includes representation 611 oriented in accordance with balance board 100. As shown, engine 501 can be configured to repeatedly receive orientation data from one or more available sensors on phone 400. This orientation data can include any type of orientation data that phone 400 may be capable of providing. For example, the orientation data could include accelerometer data defining phone 400's instantaneous acceleration in the x, y, and z directions, gyroscope data defining phone 400's instantaneous rotation in the x, y, and z directions, and/or magnetometer data defining phone 400's orientation relative to Earth's magnetic field. As a non-limiting example, when phone 400 is an iPhone, engine 501 could use a CMMotionManager object to obtain such orientation data.

Engine 501 may repeatedly obtain and maintain the orientation data such as in an orientation data stream. As shown, engine 501 may also maintain an offset that it may apply to the orientation data to ensure that representation 611 will be displayed in the proper orientation. As described below, this offset can be defined by the calibration process. Engine 501 may also obtain data for rendering a virtual environment from virtual environment database 502-3. Engine 501 may use this data to render the selected virtual environment including using the orientation data as modified by the offset to render representation 611 within the virtual environment.

Figure 12:
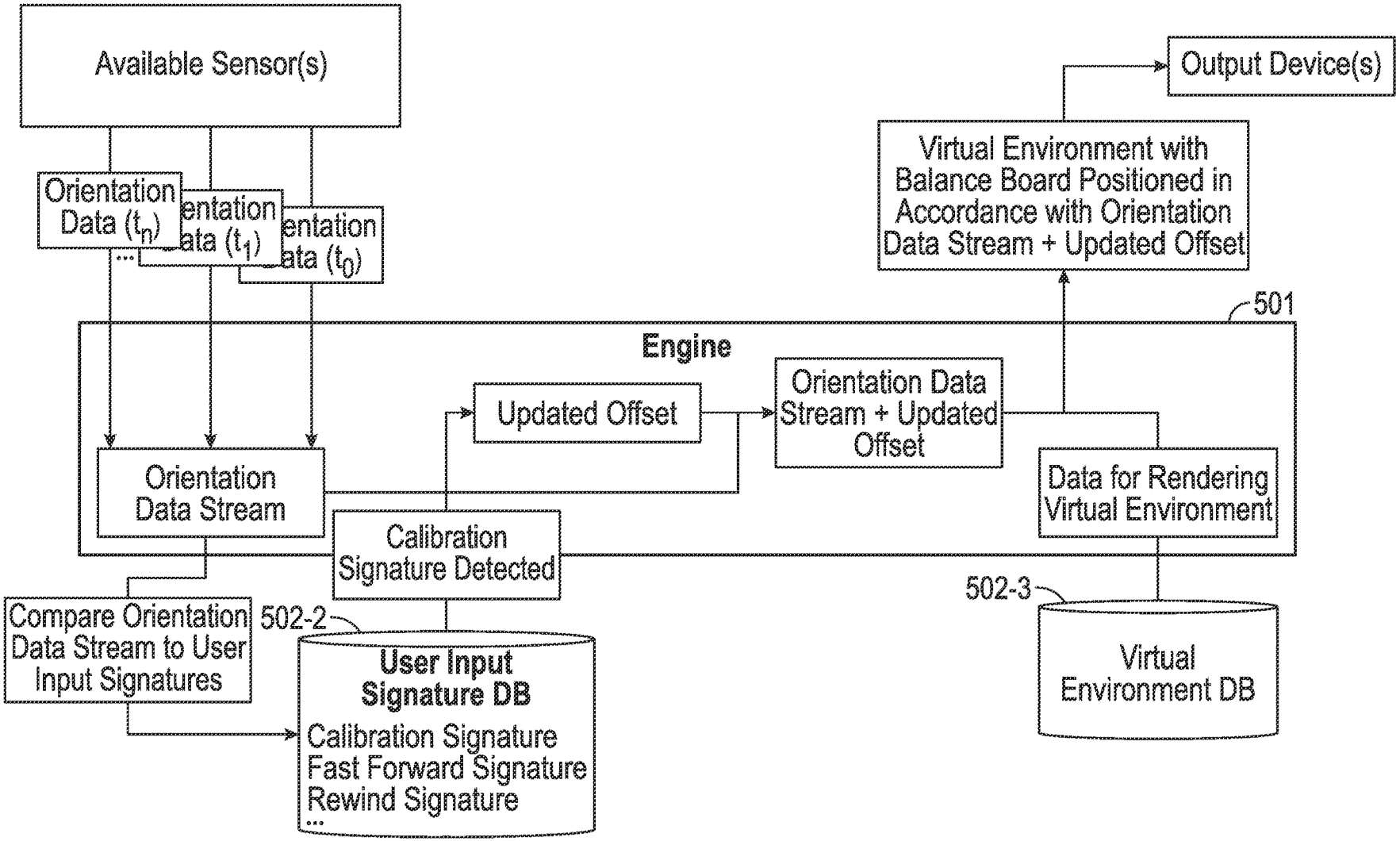
FIG. 12 represents how the software can calibrate a phone that is attached to a balance board so that a representation of the balance board is appropriately oriented in a virtual environment.

FIG. 12 provides an example of how engine 501 may perform a calibration process. As shown, user input signature database 502-2 can include a calibration signature which can define a set and/or sequence of orientation data that would be generated by phone 400's sensor(s) when the user orients balance board 100 in the defined calibration orientation (e.g., when the user holds the rear end of balance board 100 against the ground). As described with reference to FIG. 11, engine 501 can repeatedly receive orientation data. As part of receiving and processing the orientation data, engine 501 can compare the orientation data stream, or relevant portions of the orientation data stream, to signatures in user input signature database 502-2. For example, if engine 501 determines that the current orientation data in the orientation data stream matches the calibration signature, engine 501 can commence the calibration process (e.g., by commencing a timer). Then, if engine 501 determines that the current orientation data in the orientation data stream continues to match the calibration signature for the threshold amount of time, engine 501 can update the offset based on the current orientation data. For example, engine 501 could use the current orientation data generated by a magnetometer to define the value of the offset. Once the offset is updated, engine 501 can employ the updated offset when rendering representation 611 in the virtual environment.

Figure 13:
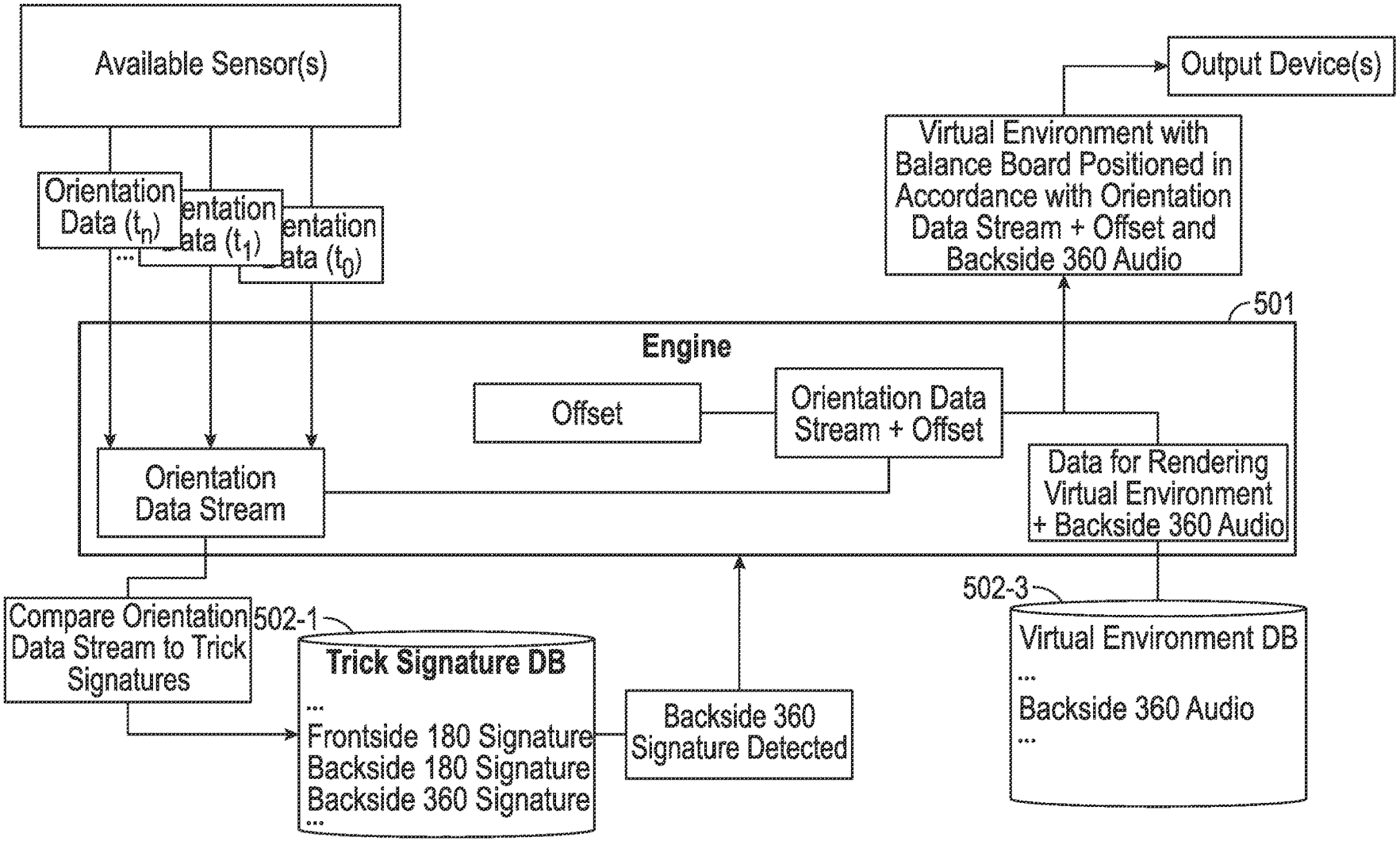
FIG. 13 represents how the software can detect when the user performs a trick or other action on a balance board and can provide feedback in the virtual environment.

FIG. 13 provides an example of how engine 501 can detect when the user performs a trick or other motion on balance board 100. In a similar manner as described with reference to FIG. 12, engine 501 can compare the orientation data stream to signatures in trick signature database 502-1 to determine if the current orientation data matches any signatures. In the depicted example, it is assumed that the user has physically rotated balance board 100 360 degrees in a clockwise direction (assuming the user has a normal stance), and therefore, the orientation data stream will include orientation data representing this rotation. It is also assumed that trick signature database 502-1 includes a backside 360 signature which defines orientation data that would be generated when the user performs a backside 360. Accordingly, by comparing the orientation data stream to the signatures in trick signature database 502-1, engine 501 can detect the occurrence of the backside 360 signature in the orientation data stream.

In conjunction with detecting the backside 360 signature in the orientation data stream, engine 501 may obtain backside 360 audio from virtual environment database 502-3 and output the audio. For example, backside 360 audio could be the words "backside 360" which could be audibly output via phone 400's speakers, a TV's speakers, or another speaker to which phone 400 may be connected. In this way, engine 501 can notify the user when the user performs a trick on balance board 100. Engine 501 can alternatively or additionally present a visual representation of the trick that was detected in the orientation data stream.

By using a balance board system configured in accordance with embodiments of the present invention, a board sport enthusiast, such as a wakesurfer, can practice the board sport much more frequently. For example, in the case of wakesurfing, a large amount of time is spent travelling to the water, launching the boat, waiting one's turn, etc. such that relatively little time is spent wakesurfing. Also, in many locations, it may only be possible to wakesurf during the summer months. Accordingly, if a wakesurfer can only practice wakesurfing while actually wakesurfing, it may take a long time for the wakesurfer to improve his or her skills. In contrast, with embodiments of the present invention, the wakesurfer can practice his or her skills in a virtual environment with feedback at virtually anytime.

Embodiments of the present invention may comprise or utilize special purpose or general-purpose computers including computer hardware, such as, for example, one or more processors and system memory. Embodiments within the scope of the present invention also include physical and other computer-readable media for carrying or storing computer-executable instructions and/or data structures. Such computer-readable media can be any available media that can be accessed by a general purpose or special purpose computer system.

Computer-readable media are categorized into two disjoint categories: computer storage media and transmission media. Computer storage media (devices) include RAM, ROM, EEPROM, CD-ROM, solid state drives ("SSDs") (e.g., based on RAM), Flash memory, phase-change memory ("PCM"), other types of memory, other optical disk storage, magnetic disk storage or other magnetic storage devices, or any other similar storage medium which can be used to store desired program code means in the form of computer-executable instructions or data structures and which can be accessed by a general purpose or special purpose computer. Transmission media include signals and carrier waves. Because computer storage media and transmission media are disjoint categories, computer storage media does not include signals or carrier waves.

Computer-executable instructions comprise, for example, instructions and data which, when executed by a processor, cause a general-purpose computer, special purpose computer, or special purpose processing device to perform a certain function or group of functions. The computer executable instructions may be, for example, binaries, intermediate format instructions such as assembly language or P-Code, or even source code.

Those skilled in the art will appreciate that the invention may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, tablets, smart watches, pagers, routers, switches, and the like.

The invention may also be practiced in distributed system environments where local and remote computer systems, which are linked (either by hardwired data links, wireless data links, or by a combination of hardwired and wireless data links) through a network, both perform tasks. In a distributed system environment, program modules may be located in both local and remote memory storage devices. An example of a distributed system environment is a cloud of networked servers or server resources. Accordingly, the present invention can be hosted in a cloud environment.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description.

What is claimed:

1. A balance board system comprising:

a balance board having a top surface, a bottom surface, and a fulcrum that is fixed at a center of the bottom surface, wherein the fulcrum has an elongated semi-spherical shape to enable the balance board to freely yaw, pitch and roll;

a mechanism for mounting a phone to the balance board while a rider stands on the top surface of the balance board; and software that is executable on the phone, the software being configured to output, to an external display, a virtual environment that includes a representation of the balance board by continuously performing the following:

obtaining orientation data from one or more sensors of the phone while the phone is mounted to the balance board;

based on the orientation data, tracking an orientation of the balance board indicative of the yaw, pitch and roll of the balance board while the rider stands on the top surface of the balance board and causes the balance board to yaw, pitch and roll;

updating the virtual environment by orienting the representation of the balance board based on the tracked orientation of the balance board such that the yaw, pitch and roll of the representation of the balance board in the virtual environment matches the yaw, pitch and roll of the balance board; and outputting the updated virtual environment that includes the representation of the balance board to the external display to thereby allow the rider to watch the yaw, pitch and roll of the representation of the balance board be updated within the virtual environment to match the yaw, pitch and roll that the rider causes the balance board to experience;

wherein the software is further configured to:

detect calibration input that is generated when the balance board remains fixed in a predefined orientation;

in response to detecting the calibration input, calculate an updated offset; and apply the updated offset to the orientation data as part of tracking the orientation of the balance board such that the yaw, pitch and roll of the representation of the balance board is oriented based on the orientation data and the updated offset after the calibration input is detected.

2. The balance board system of claim 1, wherein the mechanism for mounting the phone to the balance board comprises:

a balance board phone mount comprising:

a body having a top side and a bottom side, the body further having:

a first side and a second side opposite the first side, the first and second side defining a width of the body, the width of the body exceeding a width of the phone, the first side and second sides being configured to fold overtop and be secured to one another to thereby hold the phone against the body;

a first extension and a second extension opposite the first extension, the first and second extensions being configured to fold overtop and be secured to the first side and second side after the first side and second side have been folded overtop and secured to one another to thereby limit movement of the phone between the first and second sides; and a base positioned on the top side of the body, the base being configured to secure the body to the bottom surface of the balance board.

3. The balance board system of claim 2, wherein the body includes a third side that extends between the first and second sides and a fourth side that extends between the first and second sides opposite the third side.

4. The balance board system of claim 3, wherein the first extension extends from the third side and the second extension extends from the fourth side.

5. The balance board system of claim 4, wherein the first extension is perpendicular to the third side and the second extension is perpendicular to the fourth side.

6. The balance board system of claim 1, wherein the software is further configured to:

detect, from the orientation of the balance board, that the rider has performed a particular motion on the balance board; and cause feedback indicative of the particular motion to be output within the virtual environment.

7. The balance board system of claim 6, wherein the software is further configured to:

maintain statistics that include an indication that the rider has performed the particular motion.

8. The balance board system of claim 7, wherein the statistics also include one or more of:

a number of times that the rider has performed the particular motion on the balance board;

an indication that the rider has performed one or more other motions on the balance board;

an amount of time that the rider has used the balance board; or a number of calories that the rider has burned while using the balance board.

9. The balance board system of claim 2, wherein the body further comprises:

a first fastener positioned on the bottom side of the body at the second side;

a second fastener positioned on the top side of the body at the first side;

a third fastener positioned on the top side of the body at the second side;

a fourth fastener positioned on the first extension; and a fifth fastener positioned on the second extension.

10. The balance board system of claim 9, wherein the first fastener and the second fastener secure the first side and the second side together, the third fastener and the fourth fastener secure the first extension and the second side together and the third fastener and the fifth fastener secure the second extension and the second side together.

11. The balance board system of claim 6, wherein the particular motion is detected by comparing the orientation of the balance board to signatures of motions.

12. The balance board system of claim 6, wherein the feedback comprises one or more of:

audible feedback;

visual feedback; or a score.

13. The balance board system of claim 6, wherein the particular motion is a trick.

14. The balance board system of claim 1, wherein the software tracks the orientation of the balance board relative to the external display.

15. The balance board system of claim 1, wherein the mechanism is one of: integrated into the bottom surface of the balance board; or a balance board phone mount that is separate from the balance board.

16. A balance board system comprising:

a balance board having a top surface, a bottom surface, and a fulcrum that enables the balance board to freely yaw, pitch and roll;

a mechanism for mounting a phone to the balance board while a rider stands on the top surface of the balance board; and software that is executable on the phone, the software being configured to output, to an external display, a virtual environment that includes a representation of the balance board by continuously performing the following:

obtaining orientation data from one or more sensors of the phone while the phone is mounted to the balance board;

based on the orientation data, tracking an orientation of the balance board indicative of the yaw, pitch and roll of the balance board while the rider stands on the top surface of the balance board and causes the balance board to yaw, pitch and roll;

updating the virtual environment by orienting the representation of the balance board based on the tracked orientation of the balance board such that the yaw, pitch and roll of the representation of the balance board in the virtual environment matches the yaw, pitch and roll of the balance board; and outputting the updated virtual environment that includes the representation of the balance board to the external display to thereby allow the rider to watch the yaw, pitch and roll of the representation of the balance board be updated within the virtual environment to match the yaw, pitch and roll that the rider causes the balance board to experience;

wherein the software is further configured to:

detect calibration input that is generated when the balance board remains fixed in a predefined orientation:

in response to detecting the calibration input, calculate an updated offset; and apply the updated offset to the orientation data as part of tracking the orientation of the balance board such that the yaw, pitch and roll of the representation of the balance board is oriented based on the orientation data and the updated offset after the calibration input is detected.

17. The balance board system of claim 16, wherein the software tracks the orientation of the balance board relative to the external display.

18. The balance board system of claim 16, wherein the software is further configured to:

detect, from the orientation of the balance board, that the rider has performed a particular motion on the balance board; and cause feedback indicative of the particular motion to be output within the virtual environment.

19. A balance board system comprising:

a balance board having a top surface, a bottom surface, and a fulcrum that is fixed at a center of the bottom surface, wherein the fulcrum has an elongated semi-spherical shape to enable the balance board to freely yaw, pitch and roll;

a mechanism for mounting a phone to the balance board while a rider stands on the top surface of the balance board; and software that is executable on the phone, the software being configured to output, to an external display, a virtual environment that includes a representation of the balance board by continuously performing the following:

obtaining orientation data from one or more sensors of the phone while the phone is mounted to the balance board;

based on the orientation data, tracking an orientation of the balance board indicative of the yaw, pitch and roll of the balance board while the rider stands on the top surface of the balance board and causes the balance board to yaw, pitch and roll;

updating the virtual environment by orienting the representation of the balance board based on the tracked orientation of the balance board such that the yaw, pitch and roll of the representation of the balance board in the virtual environment matches the yaw, pitch and roll of the balance board; and outputting the updated virtual environment that includes the representation of the balance board to the external display to thereby allow the rider to watch the yaw, pitch and roll of the representation of the balance board be updated within the virtual environment to match the yaw, pitch and roll that the rider causes the balance board to experience;

wherein the mechanism for mounting the phone to the balance board comprises:

a balance board phone mount comprising:

a body having a top side and a bottom side, the body further having:

a first side and a second side opposite the first side, the first and second side defining a width of the body, the width of the body exceeding a width of the phone, the first side and second sides being configured to fold overtop and be secured to one another to thereby hold the phone against the body;

a first extension and a second extension opposite the first extension, the first and second extensions being configured to fold overtop and be secured to the first side and second side after the first side and second side have been folded overtop and secured to one another to thereby limit movement of the phone between the first and second sides; and a base positioned on the top side of the body, the base being configured to secure the body to the bottom surface of the balance board.

* * * * *